US007140809B1

(12) United States Patent
Braun

(10) Patent No.: US 7,140,809 B1
(45) Date of Patent: Nov. 28, 2006

(54) CONCRETE BLOCK SYSTEM FOR RETAINING WALLS

(76) Inventor: Maurice G. Braun, 7080 Allen Way E., Inver Grove Heights, MN (US) 55077

( * ) Notice: Subject to any disclaimer, the term of this patent is extended or adjusted under 35 U.S.C. 154(b) by 0 days.

(21) Appl. No.: 11/185,086

(22) Filed: Jul. 20, 2005

(51) Int. Cl.
*E02D 29/02* (2006.01)

(52) U.S. Cl. ..... 405/286; 405/284; 405/262

(58) Field of Classification Search ..... 405/284–286, 405/262
See application file for complete search history.

(56) References Cited

U.S. PATENT DOCUMENTS

| | | | | |
|---|---|---|---|---|
| 4,067,166 | A * | 1/1978 | Sheahan | 405/284 |
| 4,244,665 | A * | 1/1981 | Neumann | 405/286 |
| 4,613,255 | A * | 9/1986 | Bruer | 405/286 |
| 6,539,684 | B1 * | 4/2003 | Graham | 405/286 |

* cited by examiner

*Primary Examiner*—Frederick L. Lagman
(74) *Attorney, Agent, or Firm*—Thomas B. Tate

(57) ABSTRACT

A concrete block system for retaining walls. Generally L-shaped concrete blocks are laid side by side and are laid in courses, each of which is positioned slightly inward from the course immediately below it to form a retaining wall. The retaining wall, the concrete blocks used to construct the retaining wall, and a method of constructing a retaining wall using these blocks comprise the system disclosed herein.

2 Claims, 2 Drawing Sheets

CONCRETE BLOCK SYSTEM FOR RETAINING WALLS

BACKGROUND OF THE INVENTION

The field of the invention is concrete block systems for retaining walls.

Concrete blocks retaining walls have long been used in landscape architecture for both functional (for example, reducing soil erosion on hilly lots) and decorative purposes. Traditionally the blocks were mortared together or were installed using tie-backs or geo-grid systems. More recently, retaining walls have been built using interlocking blocks. One example of this is a "natural rock" retaining wall manufactured by Redi-Rock International, Charlevoix, Mich., which uses six different shapes of blocks for different parts of the wall.

The closest known prior art is the Lock+Load system manufactured by C. J. Pink, Ltd., London, Ontario, Canada, which is a two-piece system with a bottom and a face wherein the blocks lock together with a re-rod that goes through two pieces at one end. In that system, the blocks are laid at a time from the back of the wall using a stone truck, because each block weighs fifty-five to one hundred pounds.

SUMMARY OF THE INVENTION

The concrete block system for retaining walls disclosed herein has three components: the retaining wall, the concrete blocks used to make the retaining wall, and the method of making the retaining wall using the concrete blocks.

The retaining wall has generally L-shaped concrete blocks laid side by side, with each course of blocks being laid slightly inward of the course immediately below. Each block has a thin face and a thin bottom formed as a unitary structure with two re-rods running through the block. The method for making the wall includes using a loader to lay the blocks three at a time and using backfill as part of the structure.

Advantages of the present invention include the following: the thin face and thin bottom of the blocks reduce weight of the structure while the two re-rods add strength, laying each course slightly inward of the course below adds strength so that more force would be needed to push the wall outward, and laying the blocks three at a time allows for faster construction. A major advantage of the system as a whole is that it is much cheaper to build than systems currently on the market.

DETAILED DESCRIPTION OF THE INVENTION

Figure 1:
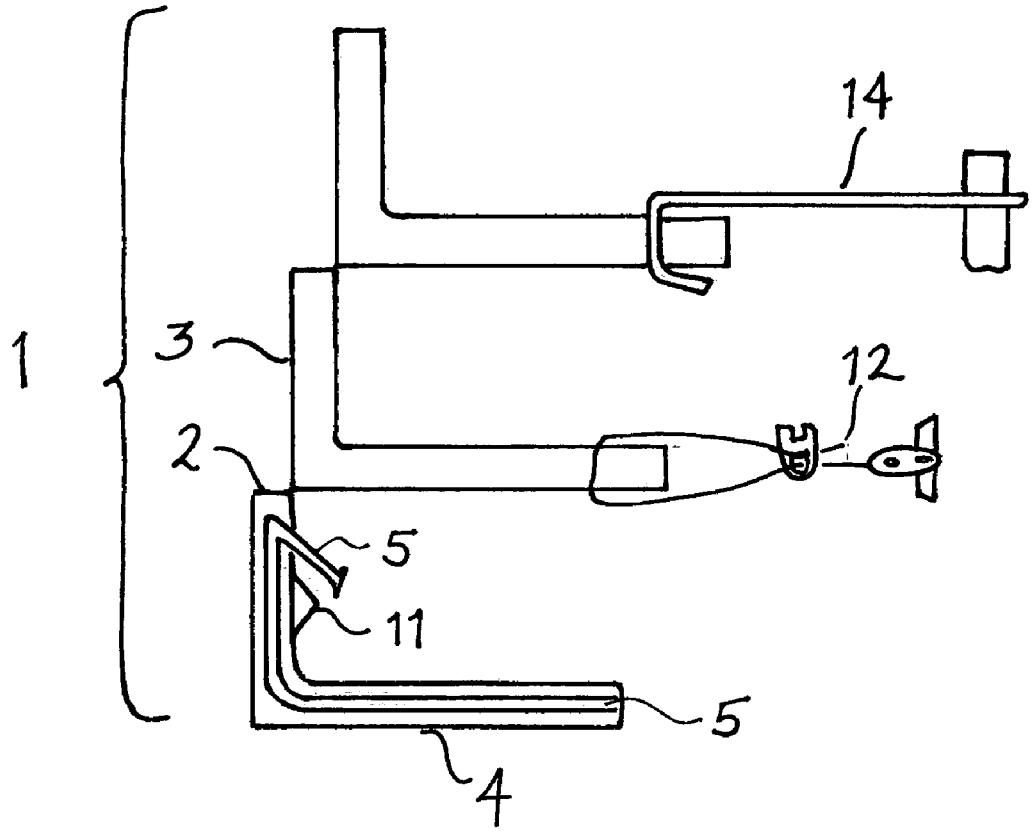
FIG. 1 is a side view.

The retaining wall 1 is comprised of a plurality of concrete blocks 2 laid side by side. The blocks 2 are laid in courses, each course being laid slightly (approximately two to three inches) inward of the course immediately below it. Because the blocks 2 lock together, the wall 1 is completely mortarless.

Each block 2 has a one-piece bottom and front formed in a generally L-shaped configuration, wherein the front (or face) 3 is upright and the bottom 4 extends rearward and generally perpendicular from the base of the front 3. The front 3 and the bottom 4 are thin and are of uniform thickness (generally two to three inches, depending upon the strength of the concrete), and the length of the block 2 from front to back is about sixteen inches. The front 3 may be a split face, a smooth face, or embossed false stone. The approximate dimensions of the face 3 are thirty inches wide by twelve inches high.

Figure 2:
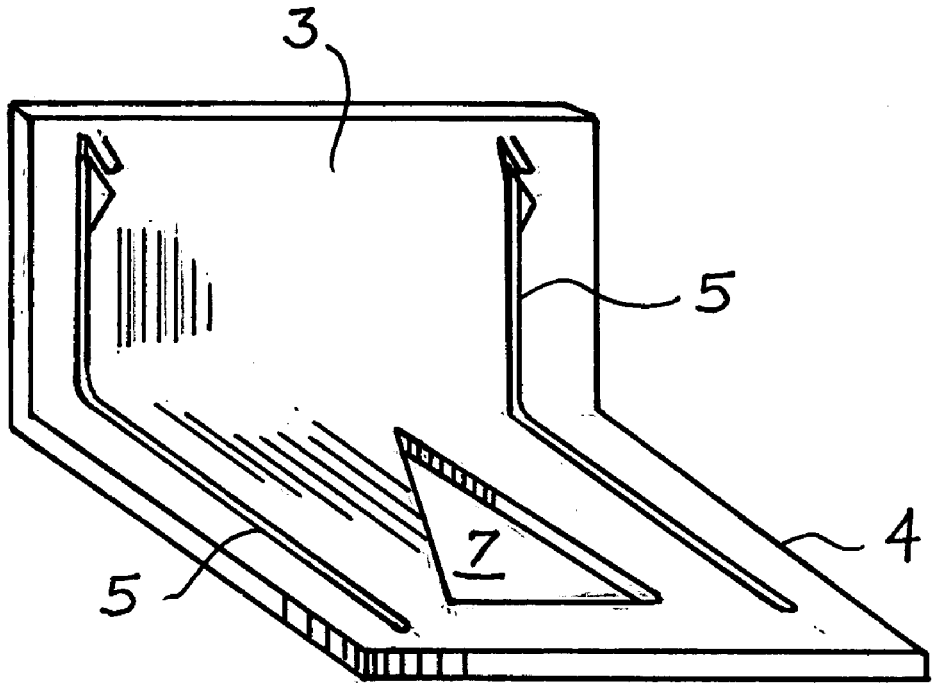
FIG. 2 is a top back perspective view of one of the blocks.

Two re-rods 5 are disposed through each block 2, in the center or slightly to the inside, to provide strength, especially at the corner, which would otherwise be a weak point. The bottom block in FIG. 1 has been drawn as if it were transparent in order to show a re-rod 5 within (in this figure the second re-rod would be directly behind the re-rod 5 shown); the other two blocks are drawn as opaque, which all the blocks actually are. In FIG. 2, the block 2 is also drawn as if it were transparent, in order to show the re-rods 5 within. Each re-rod 5 has a diameter of about three-eighths to one-half inch. The re-rods 5 each also act as lifting hooks for a metal (angle iron) lifter 11. The parts of the re-rods 5 that serve as hooks are positioned at approximately forty-five degree angles relative to the back of the face 3 of the block 2. The concrete is poured around the re-rods 5 during manufacture of the block 2 so that the ends of the re-rods 5 are projecting from the back of the front section 3 of the block 2.

A hole 7, preferably triangular in shape, cold be formed into the center of the bottom section 4 of each of the blocks 2. If present, the hole 7 causes the block 2 to resist sliding forward as dirt is compacted around block 2, and the hole 7 also makes cutting the block 2 in half easier. Blocks 2 can be cut in half using a concrete cutting saw, in order to make half blocks for use in making a staggered joint.

In making the retaining wall 1 using the blocks 2, the following method is used. A first course of blocks 2 is laid down onto solid or compacted ground and is anchored into position. The anchor could be either of the types shown in FIG. 1, or other suitable anchors known in the art. The anchor could be a duckbill anchor 12 which has a cable that wraps around a hole at a ninety degree angle, or the anchor could be a re-rod pipe anchor 14 which has a loop on one end through which galvanized pipe or a re-rod can be driven into solid ground.

The first course is full blocks. In the second course, the first block 2 (on one end of the wall 1) is a half block. The rest of the blocks 2 in the second course are full blocks. The purpose of this is to stagger the joints. In the third course, all blocks 2 are full blocks as in the first course. The fourth course starts with a half block as did the second course. This pattern of alternating by course continues as the wall 1 rises. These blocks 2 are laid three at a time, from either the front or the back of the wall 1. The three blocks 2 are picked up by a loader (for example, the type known by the trademark BOBCAT), whose bracket hooks onto the channel iron of the angle iron lifter 11. All three blocks 2 are picked up level and are taken to the site where they are to be laid. The lifter 11 comes in high from either the front side 3 of the wall 1 or the back side of the wall 1 and is lowered. The lifter 11 is self-aligning and is temporarily self-interlocking with one of the re-rods 5 sticking out of the back of the face 3, the re-rod 5 serving as a lifting hook. The three blocks 2 are lowered into position and the loader backs away.

Backfill (Class Five backfill or comparable) is put in behind the first course up to the top of the blocks 2 and is machine compacted using a plate compactor so that it is straight and level. The second course of blocks 2 is then laid slightly inward of the first course, using the same lifting and lowering procedure for laying the blocks 2 as was used for the first course and using the same backfill procedures also. The process is repeated with each succeeding course until the desired height of the wall 1 has been reached.

I claim:

1. A concrete block system for retaining walls, said system comprising:

a retaining wall comprised of a plurality of concrete blocks laid side by side, said blocks also being laid in courses, each course being laid slightly inward of the course immediately below it;

wherein each of said blocks used to construct said retaining wall has a face and a bottom formed as a unitary structure wherein said bottom projects rearward from said face, and said face and said bottom are of generally uniform thickness, each of said blocks having two re-rods disposed within said blocks, said re-rods projecting through a rear face of said block at an angle in order to receive a lifter.

2. A method of making the wall of claim 1 using the blocks described in claim 1, said method comprising the following steps: laying down a first course of said blocks, putting in backfill behind said first course of blocks and compacting said backfill so that it is straight and level, laying a second course of blocks on top of and slightly inward of said first course of blocks, backfilling behind said second course of blocks, then repeating said steps with additional courses of said blocks until the desired height of said wall is reached, wherein each course of said blocks is laid by having a loader pick up three of said blocks at a time using the lifter and bring said blocks to said wall and lower said blocks into position.

* * * * *